US007160575B1

(12) United States Patent
Pinto et al.

(10) Patent No.: US 7,160,575 B1
(45) Date of Patent: Jan. 9, 2007

(54) CONDUCTING POLYMER

(75) Inventors: Nicholas J. Pinto, Humacao, PR (US); Fouad M. Aliev, San Juan, PR (US)

(73) Assignee: University of Puerto Rico, San Juan, PR (US)

( * ) Notice: Subject to any disclaimer, the term of this patent is extended or adjusted under 35 U.S.C. 154(b) by 324 days.

(21) Appl. No.: 10/771,752

(22) Filed: Feb. 4, 2004

Related U.S. Application Data

(60) Provisional application No. 60/444,849, filed on Feb. 4, 2003.

(51) Int. Cl.
*B05D 1/18* (2006.01)

(52) U.S. Cl. ..... 427/245; 96/4; 210/500.27; 210/500.37; 210/506

(58) Field of Classification Search ..... 96/4, 96/11–14; 210/500.25, 500.26, 500.27, 500.37, 210/502.1, 506; 264/41; 427/245, 430.1; 204/400; 526/204, 258
See application file for complete search history.

(56) References Cited

U.S. PATENT DOCUMENTS 5,096,586 A * 3/1992 Kaner et al. ..... 210/500.37
5,120,807 A * 6/1992 Wei et al. ..... 526/204
5,174,883 A * 12/1992 Martin et al. ..... 204/400
6,753,041 B1 * 6/2004 Pron et al. ..... 427/389.7

OTHER PUBLICATIONS

Manuel R Bengoechea et al, "Effects of confinement on the phase separation in emeraldine base polyaniline cast from 1-methyl-2-pyrrolidone studied via dielectric spectroscopy", Journal of Physics: Condensed Matter 14 (Oct. 19, 2002), pp. 1-10.*

Yong Cao et al, Effects of Solvents and Co-solvents on the Processibility of Polyaniline: I. Solubilty and Conductivity studies, Synthetic Metals 69, published 1995, pp. 187-190.*

C. K. Chiang, C. R. Fincher, Jr., Y. W. Park, A. J. Heeger, H. Shirakawa, E. J. Lous, S. C. Gau, and Alan G. MacDiarmid; *Electrical Conductivity in Doped Polyacetylene; Physical Review Letters*; 1977; vol. 39, No. 17; pp. 1098-1101; USA.

Jin-Chih Chiang and Alan G. MacDiarmid; *'Polyaniline': Protonic Acid Doping of the Emeraldine Form to the Metallic Regime; Synthetic Metals*; 1986; pp. 193-204; USA.

(Continued)

*Primary Examiner*—Joseph Drodge
(74) *Attorney, Agent, or Firm*—Hoglund & Pamias, PS; Heath W. Hoglund

(57) ABSTRACT

Measurement in the frequency range 3 mHz–106 Hz of the dielectric characteristics of emeraldine base polyaniline dissolved in 1-methyl-2-pyrrolidinone (NMP) and cast into bulk free-standing polymer films shows features similar to those reported by others and which are a result of microphase separation into reduced and oxidized repeat units. However, upon confinement into the cylindrical pores, of average diameter 20 nm, of a porous membrane such features of microphase separation do not occur. The microphase separation observed in the bulk polymer is suppressed by strong pinning of the charge carriers due to interactions of the polymer with pore walls together with constrained chain packing and a non-uniform rate of evaporation of the NMP solvent from the pores. This enhances the bulk conductivity after doping by reducing the internal intra-chain disorder introduced by microphase separation.

10 Claims, 5 Drawing Sheets

OTHER PUBLICATIONS

H. H. S. Javadi, F. Zuo, K. R. Cromack, M. Angelopoulos, A. G. Macdiarmid, and A. J. Epstein; *Charge Transport in the "Emeraldine" Form of Polyaniline; Synthetic Metals*; 1989; pp. E409-E416; USA.

F. Zuo, M. Angelopoulos, A. G. Macdiarmid, A. J. Epstein; *ac conductivity of emeraldine polymer; Physical Review B*; 1989; vol. 39, No. 6; pp. 3570-3578; USA.

Yong Cao, Paul Smith, and Alan J. Heeger; *Counter-ion induced processibility of conducting polyaniline and of conducting polyblends of polyaniline in bulk polymers; Synthetic Metals*; 1992; pp. 91-97; USA.

Y. Z. Wang, J. Joo, C. H. Hsu, J. P. Pouget, A. J. Epstein; *Charge Transport of Hydrochloric Acid Doped Plyaniline and Poly(o-toluidene) Fibers: Role of Processing; Macromolecules*; 1994; 27; pp. 5871-5876; USA.

Chuen-Guey Wu, Thomas Bein; *Conducting Carbon Wires in Ordered, Nanometer-Sized Channels; Science*; vol. 266, No. 5187; 1994; pp. 1013-1015; USA.

Hsun-Tsing Lee, Kuen-Ru Chuang, Show-An Chen, Pei-Kuen Wei, Jui-Hung Hsu, and Wunshain Fann; *Conductivity Relaxation of 1-Methyl-2-pyrrolidone-Plasticized Polyaniline Film; American Chemical Society*; 1995; 28; pp. 7645-7652; China.

R. S. Kohlman, A. Zibold, D. B. Tanner, G. G. Ihas, T. Ishiguro, Y. G. Min, A. G. Macdiarmid, and A. J. Epstein; *Limits for Metallic Conductivity in Conducting Polymers; Physical Review Letters/The American Physical Society*; 1997; vol. 78, No. 20; pp. 3915-3918; USA.

Alan G. Macdiarmid, Yao Zhou, and Jing Feng; *Oligomers and isomers: new horizons in poly-anilines; Synthetic Metals*; 1999; pp. 131-140; USA.

Aldo J. G. Zarbin, Marco-A. De Paoli, Oswaldo L. Alves; *Nanocomposites glass/conductive polymers; Synthetic Metals*; 1999; pp. 227-235; USA.

Nicholas J. Pinto; Angel A. Acosta; Ghanshyam P. Sinha, and Fouad M. Aliev; *Dielectric permittivity study on weakly doped conducting polymers based on polyaniline and its derivatives; Synthetic Metals*; 2000; pp. 77-81; USA.

A. N. Papathanassiou; *The power law dependence of the a.c. conductivity on frequency in amorphous solids; Journal of Physics D: Applied Physics*; 2002; pp. L88-L89.

J. Y. Shimano, and A. G. Macdiarmid; *Phase segregation in polyaniline: a dynamic block copolymer; Synthetic Metals*; 2001; pp. 365-366; USA.

James Y. Shimano and Alan G. Macdiarmid; *Polyaniline a dynamic block copolymer: key to attaining its intrinsic conductivity; Synthetic Metals*; 2001; pp. 251-262; USA.

A. N. Papathanassiou, J. Grammatikakis, S. Sakkopoulos, E. Vitoratos, E. Dalas; *Localized and long-distance charge hopping in fresh and thermally aged conductive copolymers of polypyrrole and polyaniline studied by combined TSDC and dc conductivity; Journal of Physics and Chemistry of Solids*; 2002; pp. 1771-1778; Greece.

A. P. Monkman and P. Adams; *Optical and electronic properties of stretch-oriented solution-cast polyaniline films; Synthetic Metals*; 1991; pp. 87-96; United Kingdom.

A. K. Jonscher; *Dielectric relaxation in solids; Chelsea Dielectrics Press Ltd.*; 1983; pp. 96-99; London.

R. Diaz Calleja, E. S. Matveeva, V. P. Parkhutik; *Electric relaxation in chemically synthesized polyaniline: study using electric modulus formalism; Journal of Non-Crystalline Solids*; 1995; pp. 260-265; USA.

R. Richert and A. Blumen; *Disorder Effects on Relaxational Processes; Springer-Verlag*; pp. 309-311; USA.

S. Havriliak and S. Negami; *A Complex Plane Analysis of α-Dispersions in Some Polymer Systems; Journal of Polymer Science*; 1966; pp. 99-117; USA.

B. K. P. Scaife; *Principles of Dielectrics*; Clarendon Press; 1989; pp. 104-107; UK.

Betzaida Batalla, Ghanshyam Sinha and Fouad Aliev; *Dynamics of Molecular Motion of Nematic Liquid Crystal Confined in Cylindrical Pores; Mol. Cryst. Liq. Cryst.*; 1999; pp. 121-128; USA.

* cited by examiner

CONDUCTING POLYMER

CLAIM OF PRIORITY

This application claims the benefit of U.S. Provisional Application No. 60/444,849 filed Feb. 4, 2003, which is incorporated herein by reference in its entirety.

FEDERAL GRANTS

This research was supported, in part, by grants from the Office of Naval Research under grant number N00014-99-1-0558 and by the National Science Foundation (NSF) under grant number DMR-0098603.

BACKGROUND

Conducting polymers have been a focus of attention among researchers for more than two decades, since the discovery of doped polyacetylene in the 1970's. Their relatively large conductivity, light weight and flexibility are just some of the factors that make conducting polymers much more desirable than metals in certain applications. Of the various conducting polymers studied, polyaniline (PANi) has been investigated the most due to its ease of synthesis, relatively high conductivity and good stability. Depending on the oxidation level, PANi can be synthesized in various insulating forms such as the fully reduced leucoemeraldine base (LEB), half-oxidized, emeraldine base (PANiEB) and fully-oxidized, pernigraniline base (PNB). These are shown in FIGS. 1*a*, 1*b* and 1*c*. Of these three forms, PANiEB is the most stable and widely investigated polymer in this family. PANiEB differs substantially from LEB and PNB in the sense that its conductivity can be tuned via doping from $10^{-10}$ up to 100 S $cm^{-1}$ and more whereas the LEB and PNB forms cannot be made conducting. The insulating emeraldine base form of polyaniline (PANiEB) as seen in FIG. 1*c* consists of equal numbers of reduced and oxidized repeat units. The conducting emeraldine salt form (PANiES) is achieved by doping with aqueous protonic or functionalized acids where protons are added to the —N═ sites while maintaining the number of electrons in the polymer chain constant (non-redox doping). This leads to an increase in the conductivity by more than ten orders of magnitude depending on the strength of the acid and method of processing. The doping process can also be reversed by using ammonium hydroxide to reconvert the conducting salt form to the insulating base form.

PANiES is intractable and difficult to dissolve in common organic solvents, but PANiEB is soluble in 1-methyl-2-pyrrolidinone (NMP). Recently, it was reported that the observed dc conductivity of PANiES is a result of a small fraction (<1%) of the available charge carriers contributing towards charge transport. It has been suggested that the large number of isomeric forms that PANiEB can have leads to a less than optimum packing of polymer chains, thereby reducing interchain coherence. It was further shown via dielectric spectroscopy and photoluminescence studies that microphase separation of the oxidized and reduced repeat units took place in PANiEB dissolved and cast from NMP. Such microphase separation (the polymer chain consists of segments of LEB, PEB and PANiEB) can affect the bulk conductivity of PANiEB films when cast from NMP and made conducting via acid doping since the phase separated regions cannot (in their pure form) be made conducting, thereby increasing the disorder that is responsible for lowering the bulk conductivity. These methods and compounds are further described in the following references each of which is incorporated herein by reference:

1. Chiang C K, Fincher C R Jr, Park Y W, Heeger A J, Shirakawa H, Louis E J, Gau S C and MacDiarmid A G 1977 *Phys. Rev. Lett.* 39 1098–101
2. Chiang J C and MacDiarmid A G 1986 *Synth. Met.* 13 193–205
3. Monkman A P and Adams P 1991 *Synth. Met.* 40 87–96
4. Cao Y, Smith P and Heeger A J 1992 *Synth. Met.* 48 91
5. Wang Y Z, Joo J, Hsu C -H, Pouget J P and Epstein A J 1994 *Macromolecules* 27 5871–6
6. Kohlman R S, Zibold A, Tanner D B, Ihas G G, Ishiguro T, Min Y G, MacDiarmid A G and Epstein A J 1997 *Phys. Rev. Lett.* 78 3915–18
7. MacDiarmid A G, Zhou Y and Feng J 1999 *Synth. Met.* 100 131–40
8. Lee H T, Chuang K R, Chen S A, Wei P K, Hsu J H and Fann W 1995 *Macromolecules* 28 7645–52
9. Shimano J Y and MacDiarmid A G 2001 *Synth. Met.* 123 251–62
11. Shimano J Y and MacDiarmid A G 2001 *Synth. Met.* 119 365–6
12. Wu C G and Bien T 1994 *Science* 264 1757–9
13. Zarbin A J G, DePaoli M A and Alves O L 1999 *Synth. Met.* 99 227–35
14. Batalla B, Sinha G P and Aliev F M 1999 *Mol. Cryst. Liq. Cryst.* 331 1981–5
15. Havriliak S and Negami S 1966 *J. Polym. Sci. Part C* 14 99
16. Papathanassiou A N 2002 *J. Phys. D: Appl. Phys.* 35 L88–9
17. Richert R and Blumen A (ed) 1994 *Disorder Effects on Relaxational Processes* (Berlin: Springer)
18. Calleja R D, Matveeva E S and Parkhutik V P 1995 *J. Non-Cryst. Solids* 180 260–5
19. Javadi H H S, Zuo F, Cromack K R, Angelopoulos M, MacDiarmid A G and Epstein A J 1989 *Synth. Met.* 29 E409–16
20. Zuo F, Angelopolous M, MacDiarmid A G and Epstein A J 1989 *Phys. Rev. B* 39 3570–8
21. Papathanassiou A N, Grammatikakis J, Sakkopoulos S, Vitoratos E and Dalas E 2002 *J. Phys. Chem. Solids* 63 1771–8
22. Jonscher A K 1983 *Dielectric Relaxation in Solids* (London: Chelsea)
23. Jonscher A K 1999 *J. Phys. D: Appl. Phys.* 32 R57–70
24. Pinto N J, Acosta A A, Sinha G P and Aliev F M 2000 *Synth. Met.* 113 77–81
25. Scaife B K P 1989 *Principles of Dielectrics* (Oxford: Clarendon)
26. U.S. Provisional Application No. 60/444,849 filed Feb. 2, 2003.

Accordingly, an improved means for suppressing microphase separation during preparation of PANiEB films is desired.

SUMMARY OF THE INVENTION

According to one aspect of the invention, PANiEB dissolved in NMP is impregnated into cylindrical pores of a porous membrane to confine microphase separation. Dielectric studies of the impregnated porous membrane in the frequency range of 3 mHz–$10^6$ Hz demonstrate that, upon drying the confined Polymer, it does not show features of microphase separation as is the case in the bulk free-standing films cast from the same solution. This ability to dissolve the host membrane without affecting the encapsulated polymer yields itself to obtaining molecular size conducting wires when doped into the conducting state. These unexpected results, by low-frequency dielectric spectroscopy, demonstrate that PANiEB confined after polymerization into cylindrical porous membranes, suppresses the phenomenon of microphase separation.

DETAILED DESCRIPTION OF THE INVENTION

Figure 1A:
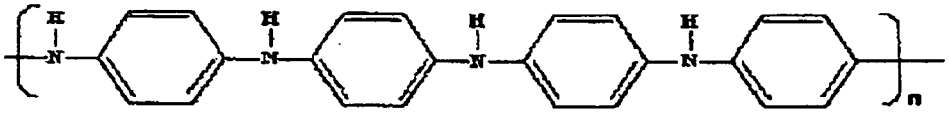
Fig. 1a (Prior Art)
FIG. 1*a* is a schematic, chemical diagram of PANi in the fully reduced oxidation state (LEB).
Figure 1B:
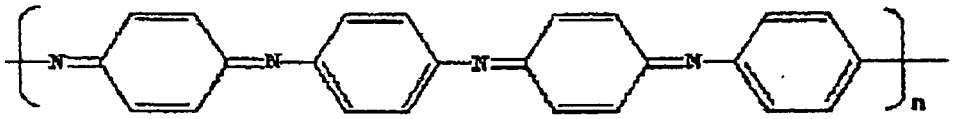
Fig. 1b (Prior Art)
FIG. 1*b* is a schematic, chemical diagram of PANi in the fully oxidized state (PNB).
Figure 1C:
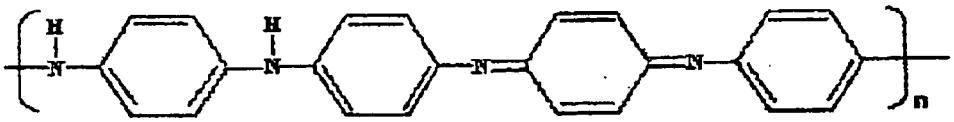
Fig. 1c (Prior Art)
FIG. 1*c* is a schematic, chemical diagram of PANi in the half-oxidized/half-reduced emeraldine base state (PANiEB).

According to one preferred aspect of the invention, a confined polymer is prepared. Its properties are measured and compared with the corresponding bulk polymer. A detailed description of the preparation and comparison follows.

Preparation

Ammonium persulfate $(NH_4)_2S_2O_8$, hydrochloric acid HCl, ammonium hydroxide $(NH_4)OH$, 1-methyl-2-pyrrolidinone (NMP)$C_5H_9NO$ and aniline $C_6H_5NH_2$ are purchased commercially and used without further purification. Following the teachings reported by Chiang and MacDiarmid (reference 2 above), 2 ml of aniline is dissolved in 30 ml of 1 M HCl and kept at 0° C., 1.15 g of $(NH_4)_2S_2O_8$ is dissolved in 20 ml of 1 M HCl also at 0° C. and added all at once under constant stirring to the aniline/HCl solution. The resulting dark green solution is maintained under constant stirring for 24 hours, filtered and washed with water before being added to a 1 M $(NH_4)OH$ solution. After an additional 24 hours the solution is filtered and a deep blue emeraldine base form of polyaniline is obtained (PANiEB). The filtrate is dried under dynamic vacuum for at least 24 hours and used as detailed below.

A 2% solution, by weight, of PANiEB and NMP is prepared by dissolving 103 mg of PANiEB in 5 ml of NMP and the solution is stirred for 48 hours. The solution is then filtered through a 0.45 μm PTFE membrane and the resulting deep blue PANiEB/NMP solution appears very uniform with no visible undissolved PANiEB. The PANiEB/NMP solution is placed in a glass bottle. A dielectrically inactive and rigid alumina Anopore cylindrical pore membrane is inserted into the bottle and capped. An Anopore membrane is a free-standing porous alumina disc of diameter 13 mm and thickness 60 μm with cylindrical parallel pores. The pores preferably have an average diameter of 20 nm and the axes of the cylindrical pores are perpendicular to the flat surface of the disc. Anopore membranes are commercially available and widely used in chromatography and dielectric spectroscopy in confined liquid crystals.

The solution of PANiEB/NMP with the porous membrane is kept in an oven at 80° C. for 24 hours. The porous membrane is then taken out of the solution and has a uniform, deep-blue color when held against the light. The porous membrane contains about 6% of the polymer by weight and the fill factor of polymer in the pores is roughly 50%. Free-standing PANiEB films are prepared from the same solution by casting onto glass slides kept in an oven at 80° C. Once the NMP evaporates, the films are then peeled off the slide by immersing the slide in water for a few seconds. Typical film thicknesses will be of the order 15–20 μm. The bulk PANiEB/NMP free-standing film, henceforth labelled 'bulk polymer', and the polymer impregnated porous membrane, henceforth labelled 'confined polymer', are kept in a vacuum oven at 80° C. for 48 hours and placed in a desiccator until the measurements are performed.

Measurements

Following the above procedure, bulk and confined polymers were prepared and their characteristics measured. Specifically, the real ($\epsilon'$) and imaginary ($\epsilon''$) parts of the complex dielectric permittivity ($\epsilon^*$) in the frequency range 3 mHz–$10^6$ Hz were determined for the polymers. The measurements were taken using a Schlumberger Technologies 1260 impedance/gain-phase analyzer in combination with a Novocontrol broad band dielectric converter and an active sample cell (BDC-S). The BDC-S with the active sample cell and containing the sample holder, the sample capacitor, high-precision reference capacitors and active electronics provides optimal measurement performance. The samples were mounted between two gold-plated parallel plates and placed in the closed cell at atmospheric pressure. The porous membrane used for the confined polymer has negligible electrical conductivity and its dielectric permittivities are practically independent of frequency and temperature. For this reason, for the confined polymer, the temperature and frequency dependences of the measured dielectric permittivities and electric modulus of the composition are membrane and polymer. The results follow.

Figure 2A:
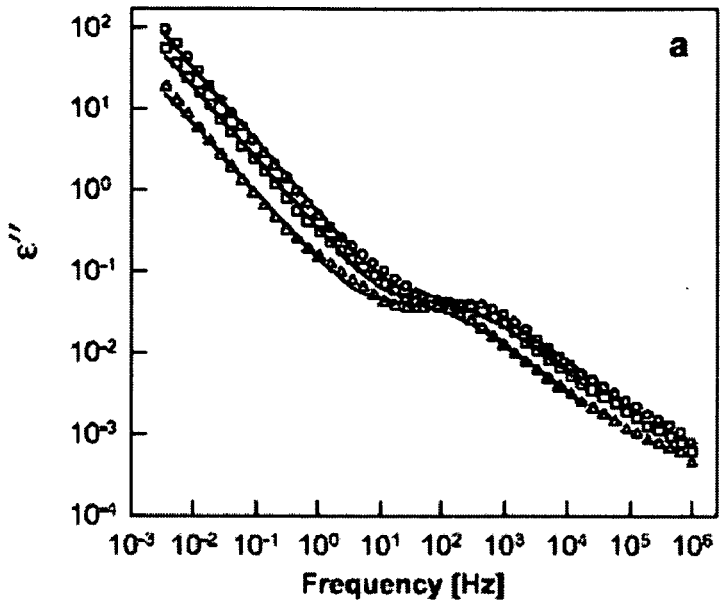
FIG. 2*a* is a plot of the frequency dependence of the imaginary part of the dielectric permittivity ($\epsilon''$) for the bulk polymer (log—log scale) at 343 (shown as Δ), 363 (shown as □) and 373 (shown as ○) ° K, respectively. The solid curves are fits using the imaginary part of equation (1), discussed below.
Figure 2B:
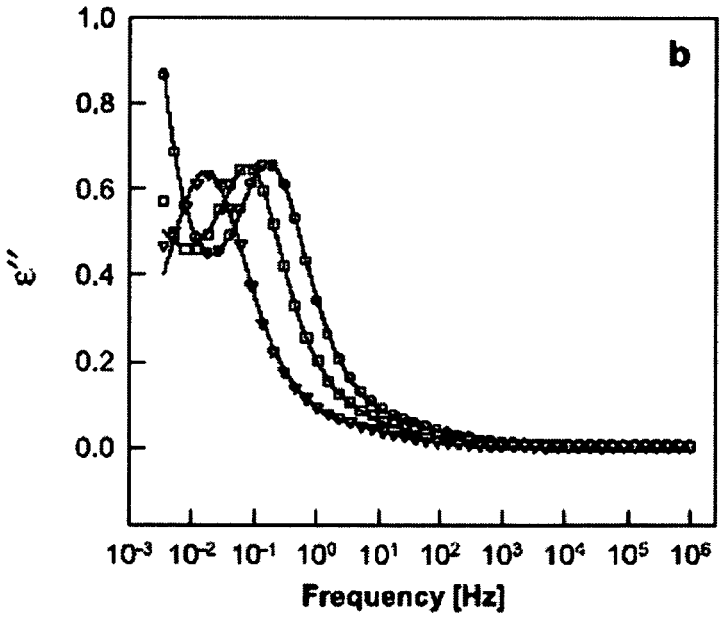
FIG. 2*b* is a plot of the frequency dependence of the imaginary part of the dielectric permittivity ($\epsilon''$) for the confined polymer (semi-log scale) at 343 (shown as Δ), 363 (shown as □) and 373 (shown as ○) ° K, respectively. The solid curves are fits using the imaginary part of equation (1), discussed below.

FIGS. 2*a* and 2*b* show $\epsilon'$ as a function of frequency on a log—log scale for the bulk polymer and on a semi-log scale for the confined polymer, respectively, at three representative temperatures of 343, 363 and 373° K. For the confined sample, the porous membrane (with the axes of the pores perpendicular to the membrane surface) was placed between the two parallel metal plates which were connected to the dielectric spectrometer. Thus the probe electric field of the dielectric spectrometer was parallel to the cylindrical pore axis of the porous membrane. As seen in FIGS. 2(*a*) and (*b*), $\epsilon''$ shows noticeable differences in the confined polymer compared with the bulk polymer. While the confined polymer exhibits a clear peak, such a peak is obscured by the onset of dc conductivity in the bulk polymer in addition to being located at a higher frequency when compared with the confined polymer at the same temperature. Since the polymer under investigation is non-polar the observed peak in FIGS. 2*a* and *b* is not associated with a structural relaxation and a dynamic glass transition (α-relaxation). Accordingly, this relaxation process can be assigned to the hopping and/or oscillations of charges around fixed pinning centers.

The data in FIGS. 2*a* and 2*b* were analyzed using the Havriliak-Negami function shown below in Equation 1:

$$\varepsilon*(\omega) = -i\frac{\sigma_o}{2\pi\varepsilon_o f^n} + \frac{\Delta\varepsilon}{(1+(i2\pi f\tau)^\alpha)^\beta} + \varepsilon_\infty \qquad \text{Equation 1}$$

Figure 4A:
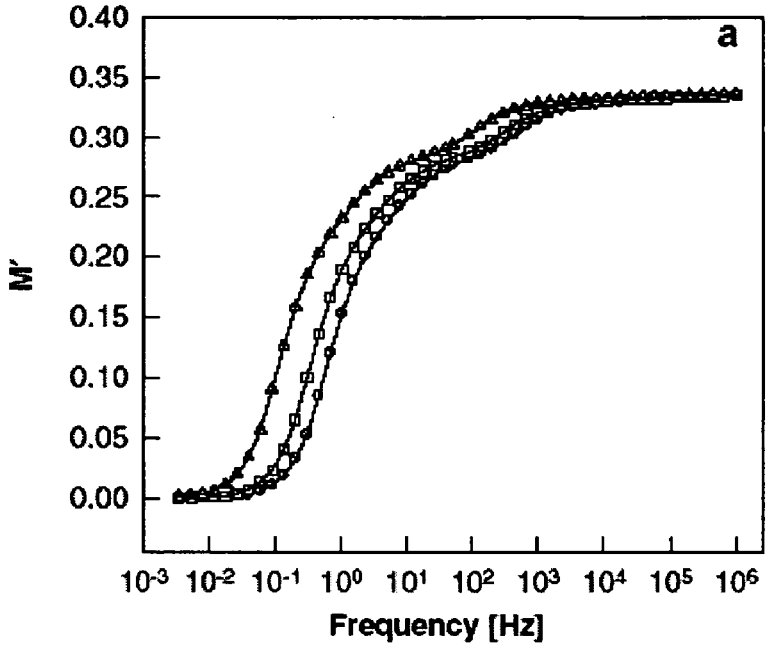
FIG. 4*a* is a plot of the frequency dependence of the real (M') part of the complex electric modulus (M*) for the bulk polymer at 343 (shown as Δ), 363 (shown as □) and 373 (shown as ○) ° K, respectively.
Figure 4B:
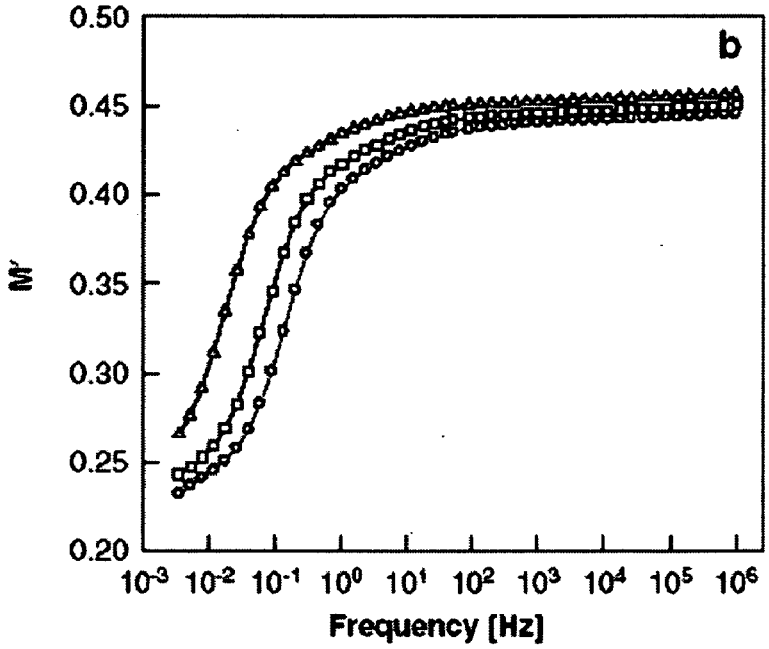
FIG. 4*b* is a plot of the frequency dependence of the real (M') part of the complex electric modulus (M*) for the confined polymer at 343 (shown as Δ), 363 (shown as □) and 373 (shown as ○) ° K, respectively.
Figure 5A:
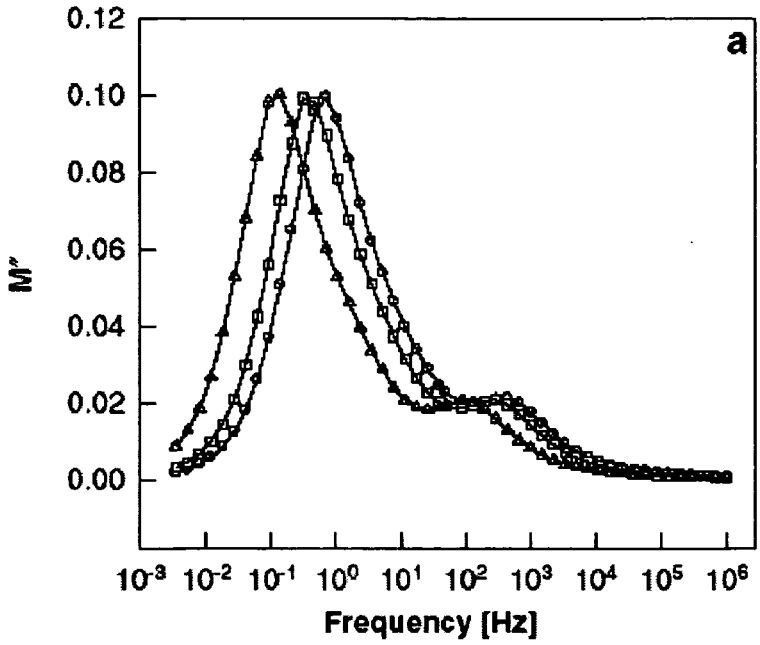
FIG. 5*a* is a plot of the frequency dependence of the imaginary part (M') of the complex electric modulus (M*) for the bulk polymer at 343 (shown as Δ), 363 (shown as □) and 373 (shown as ○) ° K, respectively.

Here, the first term on the right represents contributions from the dc conductivity. $\epsilon_o$ represents the permittivity of free space and $\epsilon_4$ represents the high-frequency limit of the real part of the dielectric permittivity, $\Delta\epsilon$ represents the dielectric strength, $\tau$ is the relaxation time and f is the frequency of the probing electric field. The parameter $\alpha$ represents the width of the distribution while $\beta$ describes the skewness of this distribution. Both parameters can take on values in the range from 0 to 1. The case $\alpha$=1 and $\beta$=1 represents the single-frequency Debye relaxation process. The relaxation processes in both samples were of the non-Debye type with $\beta$=1 and $\alpha$ ranging from 0.7 to 0.9 depending on the sample and temperature. These parameters correspond to the lower and higher temperatures, respectively. The term $i\sigma_o/2\pi\epsilon_o$ f" accounts for the contribution of ac conductivity. For Ohmic conductivity n=1. The decrease of n, i.e. n<1, could be observed, as a rule, if additionally to the contribution to $\epsilon''$ from conductivity there is an influence of electrode polarization. Additionally n could be less than 1 in conducting polymers where the ac conductivity resembles that of phononassisted hopping. Multiple ac conduction mechanisms of the Austin and Mott type may also contribute to the measured ac conductivity leading to range of n values less than 1. Application of equation (1) for data analysis shows that the strong frequency dependence of $\epsilon''$ for f<10 Hz (bulk polymer) and f<0.1 Hz (confined polymer) is due to both Ohmic conductivity and the contribution from electrode polarization. The solid lines shown in FIGS. 2*a* and 2*b* indicate fits using equation (1). The values of n in the term describing the contribution of dc conductivity to $\epsilon''$ varied from 0.9 to 0.8 for the bulk polymer in the temperature interval from 378 to 308 K respectively. Since n<1, there is not a identical relationship between $\sigma_o$ and the dc conductivity, but for some temperature range n=0.9, so that $\sigma_o$ can be estimated. Under this analysis, the bulk conductivity is greater than the conductivity of the confined sample. No significant contributions from the dc conductivity are seen in the confined polymer in the frequency range of interest, i.e. f>0.1 Hz. The relaxation times calculated from this fitting process using the data in FIGS. 2*a* and 2*b* are plotted in FIG. 3 according to the Arrhenius relation identified below in Equation 2:

$$\tau = \tau_o \exp\left(\frac{E_a}{k_B T}\right), \qquad \text{Equation 2}$$

where $\tau_o$ is the pre-exponential factor, $\epsilon_a$ is the activation energy and $k_B$ the Boltzmann constant. The relaxation times are seen to be shorter in the bulk polymer than in the confined polymer. Accordingly, the relaxation mechanisms are different for the bulk and the confined polymer. The relaxation time data for the bulk polymer were found to yield a better fit to the Vogel-Fulcher relation identified below in Equation 3:

$$\tau = \tau_o \exp\left(\frac{B}{T - T_o}\right), \qquad \text{Equation 3}$$

where $T_o$ is the Vogel-Fulcher temperature that defines a temperature where relaxation time becomes infinitely large and B is a parameter characterizing the 'fragility' of the material. In order to gain a qualitative insight into the relaxation processes seen in FIGS. 2*a* and 2*b*, the complex permittivity $\epsilon*$ is converted to the complex electricmodulus $M*(=M'+iM'')=1/\epsilon*=E/D$, where E is the applied electric field and D is the dielectric displacement. Conductivity-related losses $\epsilon''$ convert to a peak in M" so conductivity-related processes are observed in both representations. FIGS. 4 and 5 show the real and imaginary parts respectively of $M*(M'=E'/(\epsilon'^2+\epsilon''^2);\ M''=\epsilon''=\epsilon''/(\epsilon'^2+\epsilon''^2))$ plotted as a function of frequency at representative temperatures of 343, 363 and 373 K for the bulk and confined polymers. Clear differences can be seen when FIGS. 5(*a*) and (*b*) are compared with FIGS. 2(*a*) and (*b*). For the bulk polymer as seen in FIG. 5(*a*), one well-resolved peak and a shoulder are seen, whereas for the confined polymer in FIG. 5(*b*) there is only one peak. Similar results are seen for bulk PANi polymer samples cast from NMP with the proposition that these peaks correspond to phase separated regions of the phase oxidized (peak at a lower frequency) and phase reduced (peak a at higher frequency) repeat units.

Results

In conducting polymers there are no permanent dipoles. However, there is strong charge (polaron) trapping, and its localized (short range) motion under the application of an external electric field serves as an 'effective' electric dipole. The dielectric relaxation in the presence of such an alternating electric field is a result of charge hopping among available localized sites. For PANi in particular, which is a non-degenerate ground state polymer at low doping levels as is the case here, polarons and bipolarons formed during the doping and dedoping process are the relevant charge species. At low frequencies such charge hopping may extend throughout the sample in the absence of strong pinning leading to a continuous current. The relaxation process represented in FIGS. 2*a* and 2*b* arises from hopping and/or oscillations of these charges around fixed pinning centers. Increasing temperature has the effect of mobilizing the polymer chains, reducing pinning and thereby leading to a greater number of charges participating in the relaxation process for a fixed frequency. The value of the dc conductivity as extracted from the fits to the data in FIGS. 2*a* and 2*b* at 373° K is $2.66\times10^{-13}$ S $cm^{-1}$ for the bulk polymer and $1.1\times10^{-16}$ S $cm^{-1}$ for the material containing the confined polymer. Taking into account that the weight fraction of the confined polymer is about 6% of the weight of the whole sample, the conductivity of the confined polymer itself is $1.8\times10^{-15}$ S $cm^{-1}$. The conductivity of the bulk polymer is temperature dependent, varying from $8.9\times10^{-13}$ to $1.9\times10^{-15}$ S $cm^{-1}$ in the temperature range 383–298° K. For the confined polymer there was very weak temperature dependence of conductivity at relatively high temperatures T>330° K. At temperatures below 330° K there was almost no contribution of the conductivity to the measured dielectric spectra. The substantial decrease of the dc conductivity for the confined polymer as seen in FIG. 2*b* indicates that interactions of the polymer with the pores have substantially pinned the charge carriers preventing charge transport, which is not the case for the bulk polymer.

Figure 3:
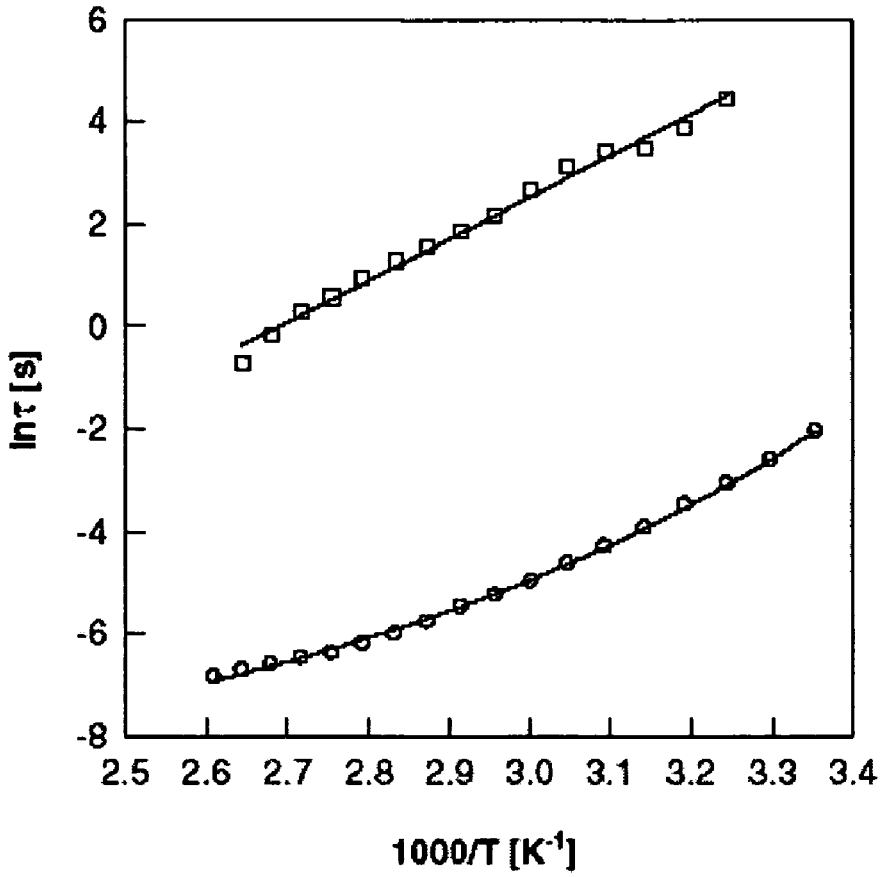
FIG. 3 is a plot of the relaxation times as calculated from fits to FIGS. 2*a* and 2*b* using the imaginary part of equation (1), discussed below, plotted as a function of inverse temperature for the bulk (shown as ○) and confined polymer (shown as □). The solid curves are fits to the data, using the Arrhenius relation of equation (2), discussed below, for the confined polymer and the Vogel-Fulcher relation of equation (3), discussed below, for the bulk polymer.

In both samples, increasing the temperature shifts the peak towards higher frequencies as a result of shorter time constants associated with increased chain movement. However it must be stated that increased chain movement does not imply efficient charge transport as there is a concomitant reduction in polymer conjugation at higher temperatures thereby increasing barrier potentials for charge transport. This effect is seen in FIG. 3 where the relaxation times for both polymers (bulk and confined) are plotted as a function of reciprocal temperature. The parameters as calculated from equation (2) for the confined sample were $\tau_o=3.57\times10^{-10}$ s, $E_a=0.69$ eV while for the bulk sample, it was found that the Vogel-Fulcher relation of equation (3) gave a better fit with $\tau_o=1.12\times10^{-5}$ s, B=730° K and $T_o$=220° K. Such a change in the mechanism is attributed to the different chemical environments encountered by the relaxing charges due to microphase separation of the polymer into LEB, PNB and PANiEB phases in one sample and not the other, as discussed later.

Charge absorption in two-component heterogeneous media gives rise to dispersion of dielectric permittivity which develops according to the following scenario: for a mixture of two or more components the accumulation of charges at the interfaces between phases gives rise to a polarization which contributes to the relaxation if at least one component has non-zero electric conductivity. This phenomenon is known as the Maxwell-Wagner (MW) effect. The MW process is described by the Debye relaxation function. In this case, for the confined polymer, the relaxation process is not described by the Debye relaxation function as it should be for the MW relaxation and there is a spectrum of relaxation times. Therefore the observed low-frequency relaxation process for a confined polymer is not attributed to the MW relaxation. Rather, this relaxation process is related to charge hopping as mentioned earlier, as observed in the bulk but modified by confinement. For the confined sample having constrained chain packing the additional barriers introduced by polymer interactions with the pore walls lead to charge trapping thereby reducing the probability of charge transport as evidenced by a decrease in the dc conductivity. This is further supported by the longer relaxation times when compared with the bulk. The presence of NMP between polymer chains also affects relaxation dynamics due to greater chain separation. Such an effect is more prominent in the confined polymer as pore filling occurs due to the flow of NMP into the pores and which when evaporated leads to larger chain separation than in the bulk.

Figure 5B:
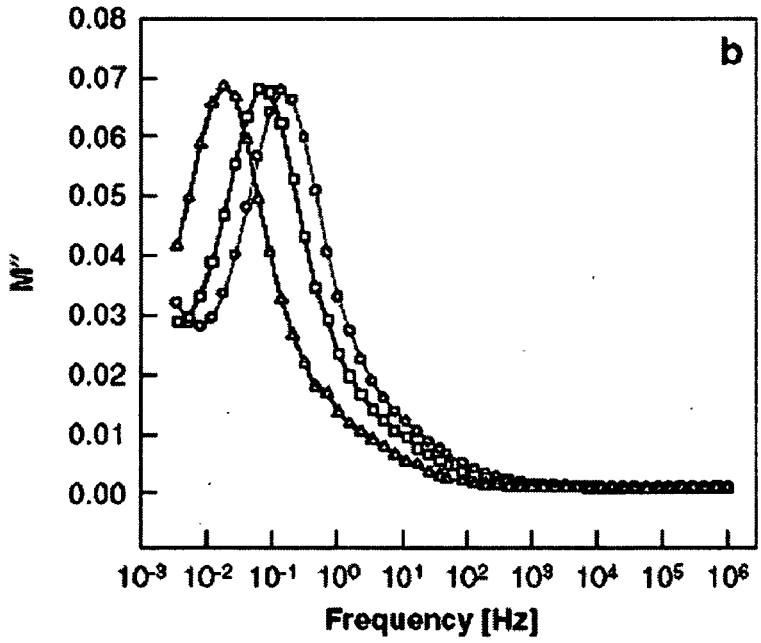
FIG. 5*b* is a plot of the frequency dependence of the imaginary part (M") of the complex electric modulus (M*) for the confined polymer at 343 (shown as Δ), 363 (shown as □) and 373 (shown as ○) ° K, respectively.

PANiEB when dissolved and cast from NMP shows microphase separation into fully oxidized and fully reduced regions. Such phase separation occurs as a result of the rapidly changing diblock nature of the polymer in solution which must freeze upon slow controlled evaporation of the solvent. The presence of a strong peak and a weak shoulder in the imaginary part of the electricmodulus (M') for the bulk polymer film as seen in FIG. 5(*a*) is similar to previous reports and is a result of microphase separation of the polymer chain into segments of LEB, PNB and PANiEB. This double peak attribute of M" is not seen in the confined polymer (as shown in FIG. 5*b*) because there is no microphase separation. FIGS. 4(*a*) and (*b*) also show slight differences between the bulk and confined polymers, although the differences are much more pronounced in FIGS. 5(*a*) and (*b*). Data taken on a pressed pellet of the bulk PANiEB powder (free of NMP) also show one peak and hence no phase separation. The NMP solvent which acts as a plasticizer has a high boiling point (202° C.) and is therefore difficult to remove completely upon drying. Thus any finite amount of NMP in the polymer will assist in phase separation and present structural barriers to increasing the bulk conductivity in addition to increasing interchain separation. Dielectric permittivity results as discussed in the previous section show that in the confined polymer there is strong pinning of the charge carriers due to interaction of the polymer with the parallel pore walls, and this together with constrained longitudinal chain packing and a non-uniform rate of evaporation of the NMP solvent from the pores shows that microphase separation, as observed in the bulk polymer, is suppressed. For the bulk polymer the shoulder at higher frequency is much weaker than the low-frequency peak for all measured temperatures, indicating a greater concentration of the phase oxidized repeat units.

CONCLUSIONS

Dielectric characteristics of bulk films of PANiEB dissolved and cast from NMP are similar to the bulk data published earlier by others, which shows microphase separation of the oxidized and reduced repeat units in PANiEB. However, when confined into parallel cylindrical pores of average diameter 20 nm, this phase separation is suppressed due to charge pinning arising from interactions of the polymer with the pore walls, constrained longitudinal chain packing and the non-uniform rate of evaporation of the solvent from the pores. Since the confined polymer does not show characteristics of microphase separation and hence reduced intrachain disorder, doping will produce higher conductivity than in the bulk counterpart. The porous membrane can be dissolved after sample annealing to remove most of the NMP and extract nanofibres from the polymer.

As shown and described above, the subject invention teaches improved methods for confining microphase separation in PANiEB. Although this synthesis has been described with reference to specific methods and by use of specific compounds and apparatus, those skilled in the art will appreciate that many variations and modifications are possible without departing from the scope and spirit of the invention. In addition, for purposes of interpreting the following claims, specific reference to a compound, method or apparatus should be read to encompass not only that specific compound, method or apparatus but also all equivalent compounds, methods or apparatus disclosed in the specification or known or which become knowable to those skilled in the art. Accordingly, the following claims should be read to include and to encompass all variations, modifications and equivalents to that which is expressly claimed, as limited only by the prior art.

We claim:

1. A method of suppressing microphase separation during preparation of PANiEB films, comprising the steps of:

dissolving PANiEB in a solution of NMP;

providing an anopore membrane having a plurality of parallel, cylindrical pores extending through the anopore membrane;

placing the anopore membrane in the solution of NMP;

removing the anopore membrane from the solution of NMP, wherein a portion of the solution remains confined within the parallel, cylindrical pores extending through the anopore membrane; and evaporating the solution that remains confined within the parallel, cylindrical pores, wherein the resulting film is formed of PANiEB and wherein the formation of PNB and LEB is suppressed by the anopore membrane.

2. The method of claim 1, wherein in the step of providing the anopore membrane, the plurality of parallel, cylindrical pores meet a top and bottom surface of the anopore membrane at a perpendicular angle.

3. The method of claim 1, wherein the step of providing the anopore membrane comprises providing a free-standing porous alumina disc having cylindrical parallel pores.

4. The method of claim 3, wherein in the step of providing the anopore membrane, the cylindrical parallel pores are approximately 20 nm in diameter.

5. A method of suppressing microphase separation in PANiEB comprising the steps of:

dissolving PANiEB in NMP to form a solution;

casting a film from the solution by immersing an anopore membrane in the solution, wherein the anopore membrane has parallel cylindrical pores; ard evaporating the NMP, wherein the cylindrical pores prevent microphase segregation of PANiEB into PNB ard LEB.

6. The method of claim 5, wherein the average diameter of the cylindrical pores is 20 nm.

7. A method of suppressing microphase separation of PANiEB comprising the steps of:

dissolving PANiEB in a solution of NMP;

confining the dissolved PANiEB in at least one pore; and evaporating the solution to confine the PANiEB, and wherein the at least one pore suppresses phase separation into PNB and LEB.

8. The method of claim 7, wherein the step of confining the dissolved PANiEB in at least one pore comprises the step of confining the dissolved PANiEB in at least one cylinder having a diameter of approximately 20 nm.

9. The method of claim 7, wherein the step of confining the dissolved PANiEB in at least one pore comprises the step of confining the dissolved PANiEB in at least one pore of an anapore membrane.

10. The method of claim 7, wherein the at least one pore suppresses phase separation into PNB and LEB by charge pinning arising from interactions of the PANiEB with the at least one pore.

* * * * *